US009203184B1

(12) United States Patent
Hui

(10) Patent No.: US 9,203,184 B1
(45) Date of Patent: Dec. 1, 2015

(54) SELF-ALIGNING CONNECTOR

(71) Applicant: AMAZON TECHNOLOGIES, INC., Reno, NV (US)

(72) Inventor: Allan Poon Hui, Redmond, WA (US)

(73) Assignee: Amazon Technologies, Inc., Reno, NV (US)

( * ) Notice: Subject to any disclaimer, the term of this patent is extended or adjusted under 35 U.S.C. 154(b) by 180 days.

(21) Appl. No.: 13/861,169

(22) Filed: Apr. 11, 2013

(51) Int. Cl.
*H01R 33/22* (2006.01)
*H01R 13/629* (2006.01)
*H01R 43/26* (2006.01)

(52) U.S. Cl.
CPC ..... *H01R 13/629* (2013.01); *H01R 43/26* (2013.01)

(58) Field of Classification Search
CPC ..... H01R 24/58
USPC ..... 439/668, 21–25
See application file for complete search history.

(56) References Cited

U.S. PATENT DOCUMENTS 1,934,799 A * 11/1933 Gunby ..... 439/17
2,298,172 A * 10/1942 Rose et al. ..... 200/51.09
2,645,759 A * 7/1953 Solari ..... 439/22
2,749,526 A * 6/1956 Petersen ..... 439/320
3,048,642 A * 8/1962 Parker, Jr. ..... 136/234
3,060,417 A * 10/1962 Blake ..... 340/508
3,193,636 A * 7/1965 Daniels ..... 200/51.12
3,208,029 A * 9/1965 Leslie ..... 439/46
3,278,885 A * 10/1966 Klinger ..... 439/279
3,396,586 A * 8/1968 MacLin et al. ..... 74/5.6 D
3,644,867 A * 2/1972 Krause ..... 439/101
3,665,509 A * 5/1972 Elkins ..... 439/42
4,037,916 A * 7/1977 Thompson, Jr. ..... 439/843
4,074,924 A * 2/1978 Lebecque ..... 439/1
4,304,452 A * 12/1981 Kiefer ..... 439/199
4,421,371 A * 12/1983 Clark et al. ..... 439/249
4,472,010 A * 9/1984 Parnello ..... 439/14
4,583,798 A * 4/1986 Blazowich ..... 439/24
5,007,852 A * 4/1991 Dean et al. ..... 439/201
5,409,403 A * 4/1995 Falossi et al. ..... 439/668
6,181,865 B1 1/2001 Saviano
6,370,020 B1 * 4/2002 Toukairin ..... 361/679.22
6,398,583 B1 * 6/2002 Zehren ..... 439/576
6,406,334 B2 * 6/2002 Chu ..... 439/668
6,855,003 B1 * 2/2005 Wyant ..... 439/502
6,916,988 B1 7/2005 Auray et al.
7,056,127 B2 * 6/2006 Suzuki et al. ..... 439/39
7,064,273 B1 6/2006 Kiely
7,896,708 B2 * 3/2011 Agevik ..... 439/669
8,636,549 B2 * 1/2014 Pratt et al. ..... 439/668
8,784,138 B2 * 7/2014 Shih et al. ..... 439/668

* cited by examiner

*Primary Examiner* — Neil Abrams
(74) *Attorney, Agent, or Firm* — Robert C. Kowert; Meyertons, Hood, Kivlin, Kowert & Goetzel, P.C.

(57) ABSTRACT

A connector system includes a connector plug and a connector receptacle. The connector plug includes a tapered surface, one or more plug-side electrical contacts on the tapered surface, and electrically insulating portions on the tapered surface. The connector receptacle includes a tapered socket and one or more socket-side electrical contacts. The socket-side electrical contacts electrically couple with corresponding plug-side electrical contacts when the connector plug is coupled in the socket. One or more of the socket-side electrical contacts or the plug-side electrical contacts extends around one of the tapered surfaces such that the electrical contract electrically couples with a mating electrical contact regardless of the orientation of the connector plug in the connector socket.

23 Claims, 7 Drawing Sheets

SELF-ALIGNING CONNECTOR

BACKGROUND

Many companies and other organizations operate computer networks that interconnect numerous computing systems to support their operations and the services they provide to their end customers distributed worldwide. For example, data centers housing significant numbers of interconnected computing systems have become commonplace, such as private data centers that are operated by and on behalf of a single organization, and public data centers that are operated by entities as businesses to provide computing resources to customers.

Many connectors are used to connect wires for charging or transferring data from one to another. Most connector plugs have to go into sockets in a particular way-meaning holding it with an appropriate orientation and plugging in with that orientation. Users are required to look at the connector and the socket, orient the connector, and then insert it. This may be tedious, difficult, requires trial/error, and problematic in low light situations.

In many connection systems, the connector plug must be precisely aligned with the receptacle in order for the plug to be installed. In addition, the plug may need to be oriented in a particular way for the plug to be inserted in the receptacle. For example, if a USB plug is installed 180 degrees from the intended orientation, the connection will fail.

In computing-intensive facilities such as data centers, a significant number of data and power connections are required. Installing a large number of connectors where alignment and orientation are critical may be time-consuming. In addition, some types of connectors may be damaged if maintenance personnel install a connector in a crooked or at the wrong orientation.

Figure 1:
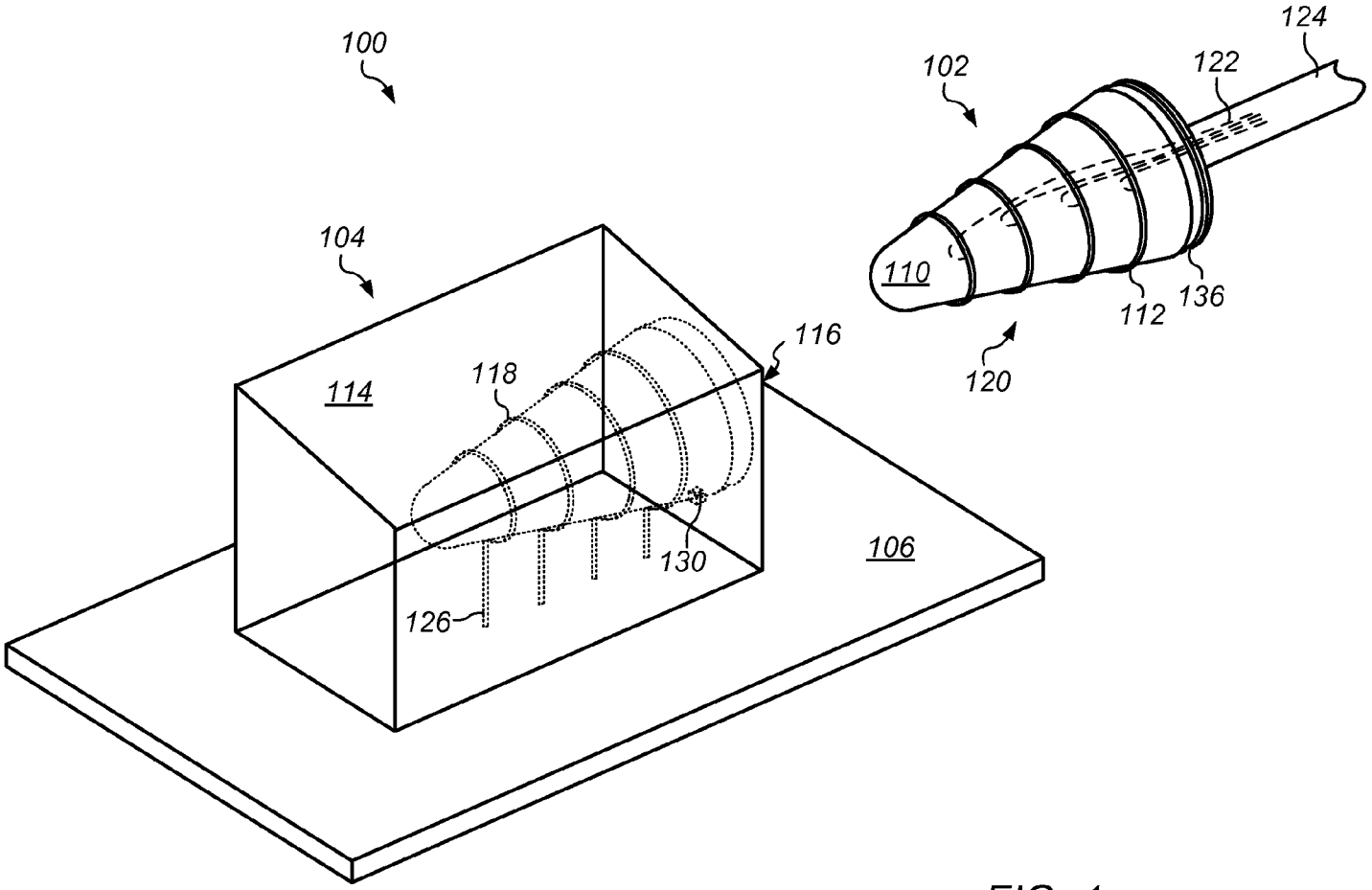
FIG. 1 illustrates one embodiment of a connection system with a complementary tapering connector plug and connector receptacle.

While embodiments are described herein by way of example for several embodiments and illustrative drawings, those skilled in the art will recognize that embodiments are not limited to the embodiments or drawings described. It should be understood, that the drawings and detailed description thereto are not intended to limit embodiments to the particular form disclosed, but on the contrary, the intention is to cover all modifications, equivalents and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION OF EMBODIMENTS

Various embodiments of connection systems and methods for making connections are described. According to one embodiment, a connector system includes a connector plug and a connector receptacle. The connector plug includes a conic surface, one or more plug-side electrical contacts on the conic surface, and electrically insulating portions on the conic surface. The connector receptacle includes a tapered socket and one or more socket-side electrical contacts. The tapered socket includes an interior conic surface that is complementary to the conic surface of the connector plug. The socket-side electrical contacts electrically couple with corresponding plug-side electrical contacts when the connector plug is coupled in the socket. One or more of the socket-side electrical contacts or the plug-side electrical contacts extends around one of the conic surfaces such that the electrical contract electrically couples with a mating electrical contact regardless of the orientation of the connector plug in the connector socket.

According to one embodiment, a connector system includes a connector plug and a connector receptacle. The connector plug includes a tapered surface, one or more plug-side electrical contacts on the tapered surface, and electrically insulating portions on the tapered surface. The connector receptacle includes a tapered socket and one or more socket-side electrical contacts. The socket-side electrical contacts electrically couple with corresponding plug-side electrical contacts when the connector plug is coupled in the socket. One or more of the socket-side electrical contacts or the plug-side electrical contacts extends around one of the tapered surfaces such that the electrical contract electrically couples with a mating electrical contact regardless of the orientation of the connector plug in the connector socket.

According to one embodiment, a method of a making an electrical connection includes inserting a connector plug having a tapered surface into a connector receptacle having a tapered socket such that one or more electrical contacts on the tapered surface of the plug couple with one or more electrical contacts on the connector receptacle. The connector plug is latched in the connector receptacle. When the connector plug is advanced into the socket, an electrical connection is made between at least one pair of mating contacts regardless of the orientation of the connector plug in the connector receptacle.

As used herein, a "cable" includes any cable, conduit, or line that carries one or more conductors and that is flexible over at least a portion of its length. A cable may include a connector portion, such as a plug, at one or more of its ends.

As used herein, "computing device" includes any of various devices in which computing operations can be carried out, such as computer systems or components thereof. One example of a computing device is a rack-mounted server. As used herein, the term computing device is not limited to just those integrated circuits referred to in the art as a computer, but broadly refers to devices including a processor, a microcontroller, a microcomputer, a programmable logic controller (PLC), an application specific integrated circuit, and other programmable circuits, and these terms are used interchangeably herein. Some examples of computing devices include e-commerce servers, network devices, telecommunications equipment, medical equipment, electrical power management and control devices, and professional audio equipment (digital, analog, or combinations thereof). In various embodiments, memory may include, but is not limited to, a computer-readable medium, such as a random access memory (RAM). Alternatively, a compact disc—read only memory (CD-ROM), a magneto-optical disk (MOD), and/or a digital versatile disc (DVD) may also be used. Also, additional input channels may include computer peripherals associated with an operator interface such as a mouse and a keyboard. Alternatively, other computer peripherals may also be used that may include, for example, a scanner. Furthermore, in the some embodiments, additional output channels may include an operator interface monitor and/or a printer.

As used herein, "data center" includes any facility or portion of a facility in which computer operations are carried out. A data center may include servers dedicated to specific functions or serving multiple functions. Examples of computer operations include information processing, communications, simulations, and operational control.

As used herein, a "latch mechanism" means a mechanism that inhibits separation of two elements (such as a connector plug and a mating connector receptacle) until the mechanism is released by a user. Releasing a latching mechanism may include, for example, pushing a release tab, or exerting a separation force sufficient to overcome the holding force of the latch mechanism.

As used herein, a "plug" of a connector means any element or device on a cable that can be used to electrically or optically connect the cable with another device or element.

As used herein, a "receptacle" of a connector means any element or device that can receive or couple with a connector plug, or a portion thereof.

As used herein, a "release element" means an element, or combination thereof, that can be operated (for example, actuated, turned, pushed, or pulled) to release a device or component. For example, a connector plug may include a release tab that is depressed to unlatch the connector plug from a receptacle in which it is installed.

As used herein, "tapered", as applied to a surface of a plug, means that the surface reduces or diminishes toward the tip of the plug. As used herein, a "tapered", as applied to a socket, means reducing or diminishing toward the bottom of the socket.

As used herein, a "ring" is an element that goes at least partially around another element. A ring may be any shape, including, for example, circular, square, rectangular, hexagonal, or elliptical. In certain embodiments, a ring includes one or more breaks. For example, a circular ring may be split at one point around the circumference of the ring. A ring may be made in any manner, including stamping, forming, or molding, and from any suitable material. In one embodiment, a ring is made metal. In some embodiments, a ring includes multiple sections, sequentially arranged to extend around the body of a connector plug or socket.

In some embodiments, a connection system includes a connector plug and a mating connector receptacle. The plug and the receptacle may have complementary tapered surfaces. The tapered surfaces may include a conic surface, an arcuate surface (for example, an elliptical or spherical surface), or two or more flat surfaces (for example, a pyramid having four triangular facets). The complementary tapered surfaces facilitate installation of the plug into the receptacle. One or more electrical contact rings on one side of the connection make the connector system orientation-"agnostic", such that an electrical connection is made regardless of the orientation of the plug when it is coupled in the receptacle.

In one embodiment, a connection system includes a connector plug and a mating connector receptacle. The plug and the receptacle have complementary conic surfaces. The tapered surfaces facilitate installation of the plug into the receptacle. One or more ring electrical contacts on one side of the connection are such that an electrical connection is made regardless of the orientation of the plug when it is coupled in the receptacle.

The connector plug may be smaller at the tip than at the base of the connector. As the tapered portion of the connector plug is advanced into the connector plug, contact between the tapered surfaces of the receptacle socket and the complementary tapered surfaces of the connector plug self-aligns the connector plug in the receptacle.

In some embodiments, a connection system includes a connector plug that is shaped in a cone, with a connector receptacle with a socket that is shaped as a funnel. The shape of the connector and socket guide the connection process. In one embodiment, a user can be directionally off by 2 to 3 millimeter in any direction and the connector will guide itself into the socket.

FIG. 1 illustrates one embodiment of a connection system with a complementary tapering connector plug and receptacle. Connection system 100 includes connector plug 102 and connector receptacle 104. Connector receptacle 104 is mounted on printed circuit board 106.

Connector plug 102 includes plug body 110 and plug-side electrical contacts 112. Connector receptacle 104 includes receptacle body 114, socket 116, and socket-side electrical contacts 118. Plug body 110 includes conic section 120. Conic section 120 tapers toward the tip of connector plug 102. Socket 116 is tapered from a larger cross section at the exterior face of receptacle body 114 to a smaller diameter at the bottom of socket 116. The taper of socket 116 may be complementary to that of the conic section 120 of connector plug 102 (for example, having a matching angle of taper).

The angle of taper of a tapered plug and/or mating receptacle may vary from embodiment to embodiment. In one embodiment, for example, the distal electrical contact of a connector plug (such as connector plug 102 shown in FIG. 1) has a diameter that is about ⅓ of the diameter of the opening of a receiving socket. In certain embodiments, the distal electrical contact of connector plug has a diameter that is less than ⅓ of the diameter of an opening of the receiving socket.

Plug-side electrical contacts 112 and socket-side electrical contacts 118 are each in the form an electrically conductive ring. Plug body 110 and receptacle body 114 may be made of an electrically insulating material. Thus, each of plug-side electrical contacts 112 is insulated from the other plug-side electrical contacts 112 in connector plug 102, and each of socket-side electrical contacts 118 is electrically insulated from the other socket-side electrical contacts 118.

Each of plug-side electrical contacts 112 is electrically connected (for example, by soldering) to one of the cable conductors 122. Cable conductors 122 may be bundled in cable 124. Cable conductors 122 may be electrical connected to an external system (for example, a power component or a network switch). In cases where connection system 100 is an electrical power connector, one of cable conductors 122 may be a hot conductor, and another one of cable conductors 122 may be a neutral conductor.

Each of socket-side electrical contacts 112 is electrically connected (for example, by soldering) to one of the board-mount conductors 126. Board-mount conductors 126 may electrically connect socket-side electrical contacts 112 with electrical conductors on printed circuit board 106.

When connector plug 102 is fully installed in connector receptacle 104, each of plug-side electrical contacts 112 may align with, and contact, a corresponding one of socket-side electrical contacts 118. In some embodiments, the contact on one side of the connection is biased (for example, spring-loaded) to urge the contact into engagement with the mating contact on the other side of the connector.

Each mating pair of plug-side electrical contacts 112 and socket-side electrical contacts 118 may electrically couple with one another regardless of the orientation of connector plug 102 in connector receptacle 104. In some embodiments, connector plug 102 rotates freely in socket 116 when connector plug 102 is in the fully installed condition.

In various embodiments, a latching mechanism inhibits a connector plug from coming out of or separating from a mating receptacle. In the embodiment shown in FIG. 1, for example, latching mechanism 130 may inhibit connector plug 102 from coming out of connector receptacle 104. In certain embodiments, a connector plug may be held in place by way of a threaded connection (for example, a threaded sleeve of a connector plug that couples with a corresponding threaded base on a connector receptacle). In some embodiments, a connector is maintained by way of a snap-in connection.

Figure 2A:
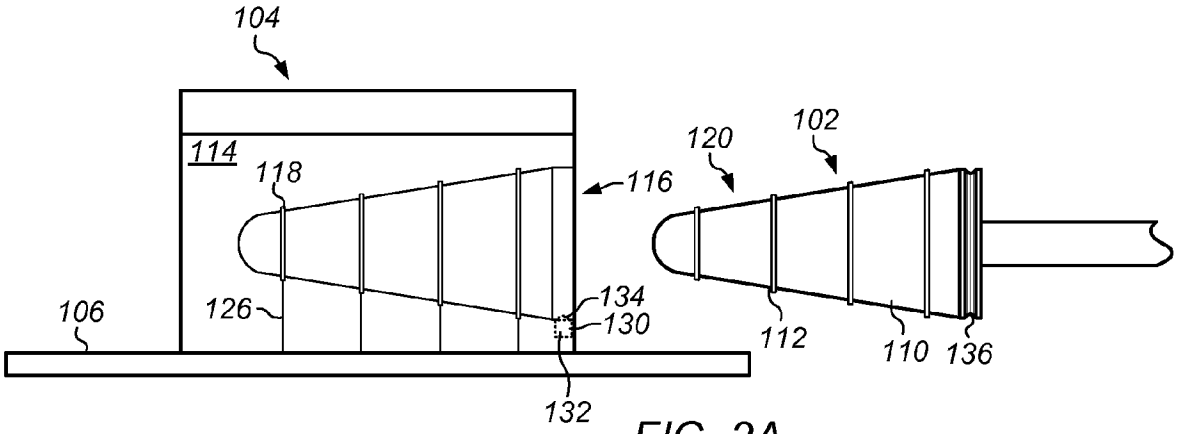
FIG. 2A and FIG. 2B illustrate installation of a connector plug into a mating connector receptacle with a latching mechanism.
Figure 2B:
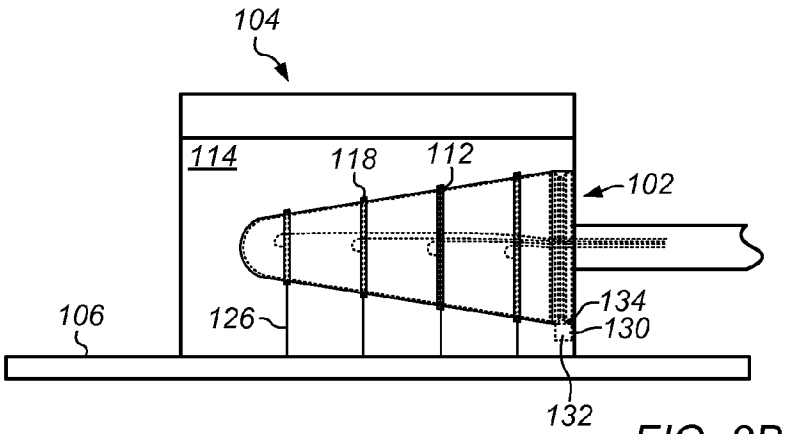

FIG. 2A and FIG. 2B illustrate installation of a connector plug into a mating connector receptacle with a latching mechanism. Latching mechanism 130 includes base 132 and spring-loaded ball 134. Initially, connector plug 102 may be positioned in front of connector receptacle 104, such as shown in FIG. 2A. Connector plug 102 may be advanced by a user into connector receptacle 104 (for example, to the position shown in FIG. 2B.) When connector plug 102 has been advanced into connector receptacle 104, groove 136 on connector plug 102 may align with spring-loaded ball 134. Spring-loaded ball 134 may be urged into engagement in groove 136, thereby inhibiting separation of connector plug 102 from connector receptacle 104.

In some embodiments, a latching mechanism for a connection system includes a release element. The release element may be operated by a user to release a connector plug from engagement in a connector receptacle. A release element may include, for example, a release tab or a release button.

In certain embodiments, a latching mechanism for a connection system is external a connector socket. For example, a latching mechanism may be located on a block external to socket 116.

In certain embodiments, latching elements are included in one or more mating electrical contacts of a connection system. For example, one or more of socket-side electrical contacts 118 may engage a corresponding plug-side electrical contact 112 to latch connector plug 102 in place in connector receptacle 104.

Although connector receptacle 104 is shown for illustrative purposes as a circuit board-mounted receptacle, a connection system with tapered connecting elements may be mounted in any suitable manner. In one embodiment, a connector receptacle including tapered elements is a panel-mount connector. In certain embodiments, a connection system with tapered plug and receptacle are used to join two cables with one another.

Although connector receptacle 104 is shown for illustrative purposes as a connected by way of conductive elements in a body of a receptacle, contacts of a connection system may, in various embodiments, be connected to system components in other manners.

In the embodiment shown in FIG. 1, connection system 100 is shown for illustrative purposes as including 4 mating contacts. A connection system may, nevertheless, have any number of mating electrical contacts. In one embodiment, a connection system includes three pairs of mating electrical contacts. An electrical connector may include contacts for transmitting power, signals, data, or combinations thereof. In one embodiment, connector 102 includes some power contacts and some data contacts.

Figure 3:
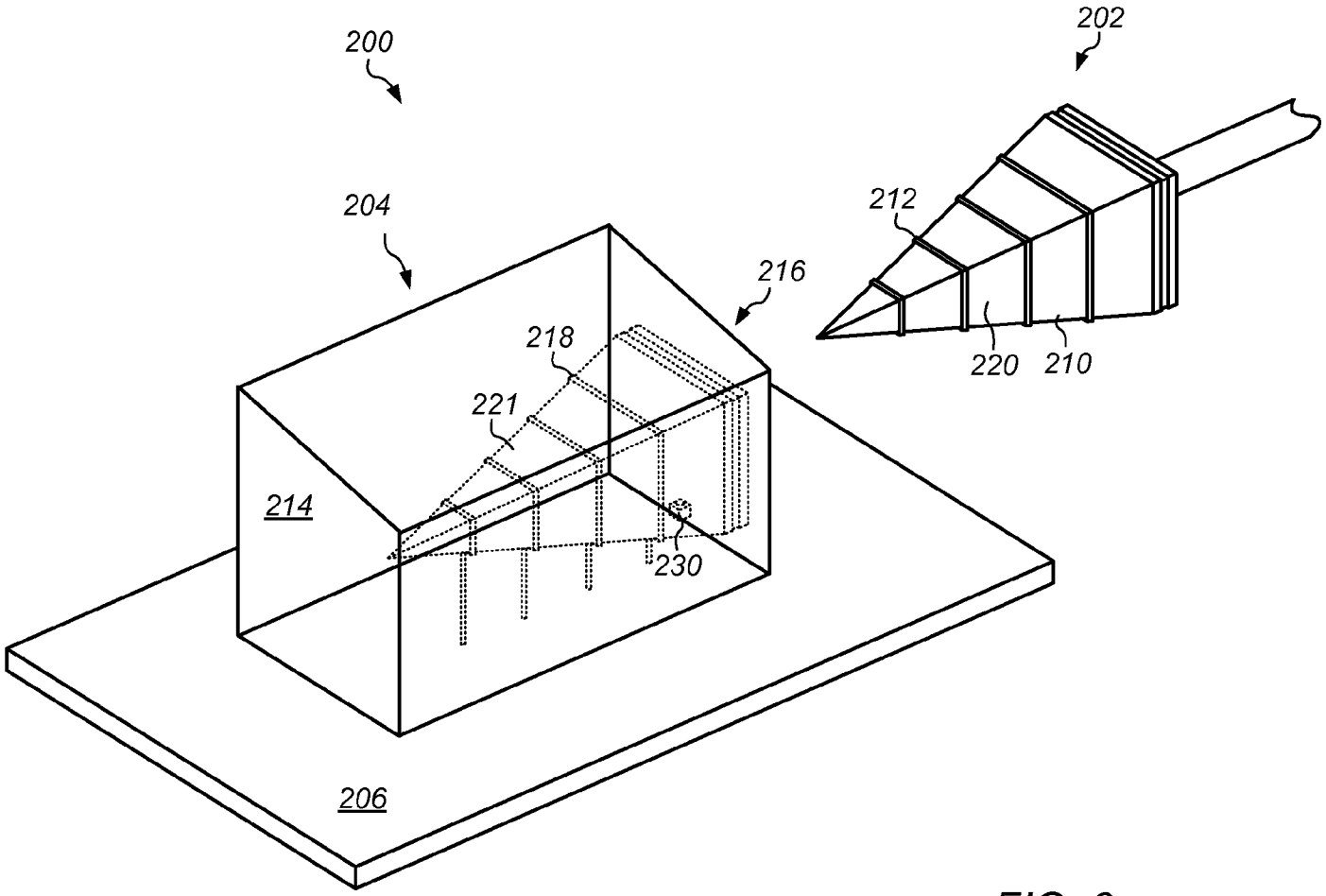
FIG. 3 illustrates one embodiment of a connection system with complementary tapered facets on a connector plug and connector receptacle.

In some embodiments, a connection system includes a connector plug with flat surfaces and a mating connector receptacle with complementary flat surfaces. FIG. 3 illustrates one embodiment of a connection system with complementary tapered facets. Connection system 200 includes connector plug 202 and connector receptacle 204. Connector receptacle 204 is mounted on printed circuit board 206.

Connector plug 202 includes plug body 210 and plug-side electrical contacts 212. Connector receptacle 204 includes receptacle body 214, socket 216, and socket-side electrical contacts 118. Plug body 210 includes tapered facets 220. Tapered facets 220 taper toward the tip of connector plug 202. Socket 216 includes tapered facets 221. Socket 216 diminishes from a larger cross section at the exterior face of receptacle body 214 to a smaller cross section at the bottom of socket 216. The taper of interior facets 219 of socket 216 may be complementary to that of the tapered facets 220 of connector plug 202 (for example, having a matching angle of taper). The angle of taper of a tapered plug and/or mating receptacle may vary from embodiment to embodiment.

Plug-side electrical contacts 212 and socket-side electrical contacts 218 are each in the form an electrically conductive ring. Plug body 210 and receptacle body 214 may be made of an electrically insulating material. Thus, each of plug-side electrical contacts 212 is insulated from the other plug-side electrical contacts 212 in connector plug 202, and each of socket-side electrical contacts 218 is electrically insulated from the other socket-side electrical contacts 218. Plug-side electrical contacts 212 and socket-side electrical contacts 218 may be soldered to leads or attached to conductors on either side of the connection.

Connector plug 202 may be coupled in connector receptacle 204 in any one of 4 orientations (for example, 0 degrees, 90 degrees, 180 degrees and 270 degrees). When connector plug 202 is fully advanced in connector receptacle 204, latching mechanism 230 may latch connector plug 202 to inhibit separation of connector plug 202 and connector receptacle 204.

In the embodiment shown in FIG. 3, the connector plug and mating receptacle have four faces. A connection system with tapered surfaces may, nevertheless, in various embodiments have any number of sides, facets, or surfaces. In various embodiments, for example, a connector plug and mating receptacle include three sides, six sides, or many sides.

Figure 4:
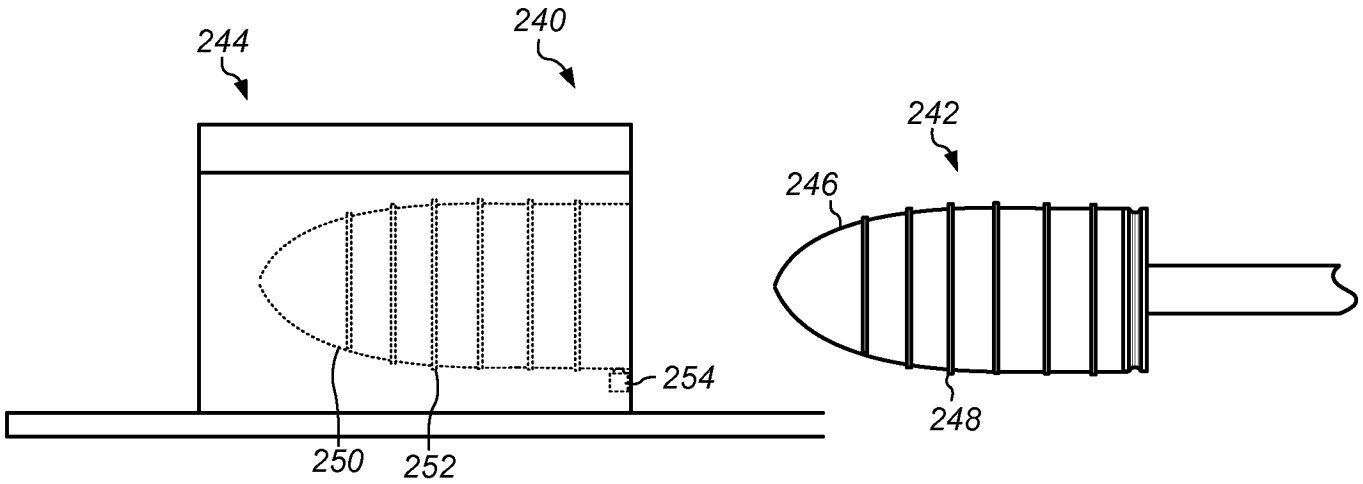
FIG. 4 illustrates ring contacts on an arcuate surface of a connector plug.

FIG. 4 illustrates ring contacts on an arcuate surface of a connector plug. Connection system 240 includes connector plug 242 and connector receptacle 244. Connector plug 242 includes elliptical surface 246 and ring contacts 248. Connector receptacle 244 includes elliptical surface 250 and ring contacts 252. Elliptical surface 246 and elliptical surface 250 are complementary to one another. Ring contacts 248 and ring contacts 252 may couple with each other when connector plug 242 is installed in connector receptacle 244. Latching mechanism 254 may hold connector plug 242 in place in connector receptacle 244.

Figure 5:
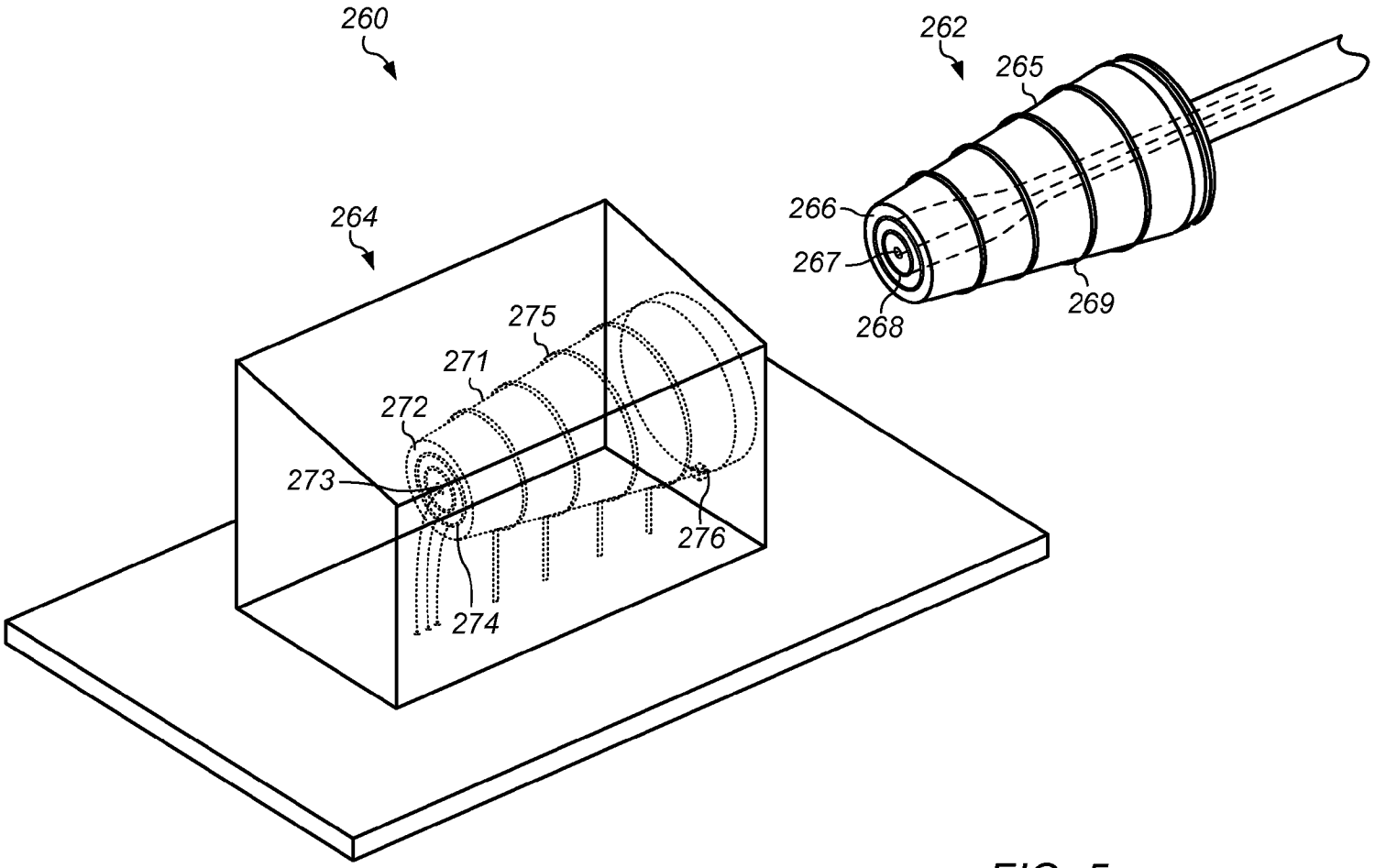
FIG. 5 illustrates one embodiment of a connector system with electrical contacts on a tapered surface and on an end face of a connector plug.

In some embodiments, a connector system that is orientation-independent includes contacts on the end of the connector plug. FIG. 5 illustrates one embodiment of a connector system with electrical contacts on a tapered surface and an end face of the connector plug. Connection system 260 includes connector plug 262 and connector receptacle 264. Connector plug 262 includes tapered surface 265, end face 266, tip contact 267, end ring contacts 268, and side ring contacts 269. Connector receptacle 264 includes tapered surface 271, end face 272, tip contact 273, end ring contacts 274, and side ring contacts 275. Tapered surface 265 and tapered surface 271 are complementary to one another. When connector plug 262 is coupled in connector receptacle 264, corresponding tip contacts, end face contacts, and side contacts on connector plug 262 in place in connector receptacle 264 may couple with one another. Latching mechanism 276 may hold connector plug 262 in place in connector receptacle 264. Because the mating tip and ring contacts will contact one another in any orientation of connector plug 262, connections in connection system 260 are made regardless of the orientation of connector plug 262 in connector receptacle 264.

Figure 6:
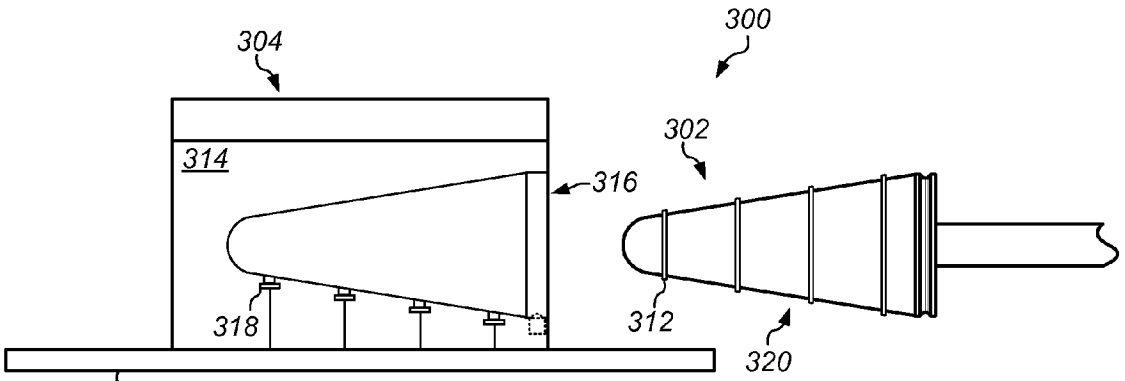
FIG. 6 illustrates one embodiment of a connection system having a connector plug with ring contacts that engage local contacts in a receptacle socket.

In some embodiments, ring contacts on one side a connection interface electrical couple with local contacts on the other side of the interface. FIG. 6 illustrates one embodiment of a connection system having a connector plug with ring contacts that engage local contacts in a receptacle socket. Connection system 300 includes connector plug 302 and connector receptacle 304. Connector receptacle 304 is mounted on printed circuit board 306. Connector plug 302 includes plug body 310 and plug-side ring contacts 312. Connector receptacle 304 includes receptacle body 314, socket 316, and socket-side local contacts 318. Plug body 310 includes conic section 320. Conic section 320 tapers toward the tip of connector plug 302. The taper of socket 316 may be complementary to that of the conic section 318 of connector plug 302 (for example, having a matching angle of taper). Plug body 310 and receptacle body 314 may be made of an electrically insulating material.

Each of socket-side local contacts 318 may be spring loaded to bear against a corresponding one of plug-side ring contacts 312. In some embodiments, one or more of socket-side local contacts 318 includes a groove into which a corresponding one of ring contacts 318 falls when connector plug 302 is fully installed. Engagement of the ring contact in the groove may inhibit connector plug 302 from pulling out of socket 316.

Figure 7:
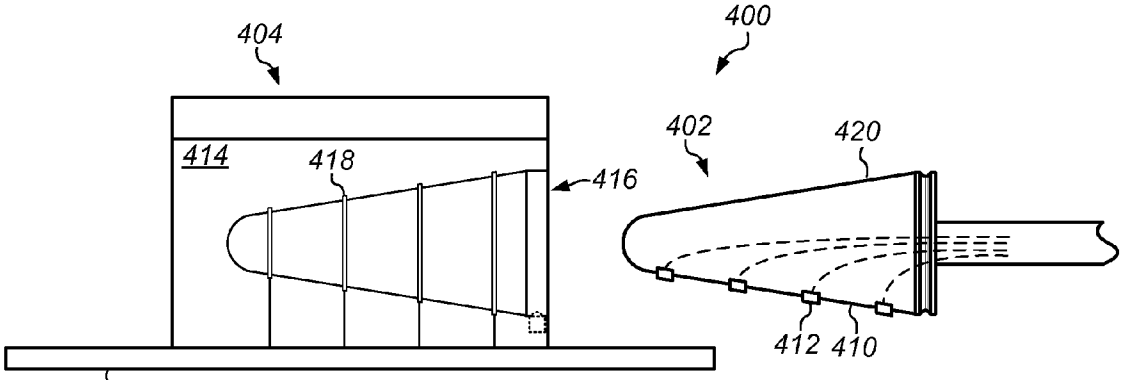
FIG. 7 illustrates one embodiment of a connection system having a connector plug with local contacts that engage ring contacts in a receptacle socket.

FIG. 7 illustrates one embodiment of a connection system having a connector plug with local contacts that engage ring contacts in a receptacle socket. Connection system 400 includes connector plug 402 and connector receptacle 404. Connector receptacle 404 is mounted on printed circuit board 406. Connector plug 402 includes plug body 410 and plug-side ring contacts 412. Connector receptacle 404 includes receptacle body 414, socket 416, and socket-side local contacts 418. Plug body 410 includes conic section 420. Conic section 420 tapers toward the tip of connector plug 402. The taper of socket 416 may be complementary to that of the conic section 418 of connector plug 402 (for example, having a matching angle of taper). Plug body 410 and receptacle body 414 may be made of an electrically insulating material.

Each of plug-side local contacts 412 may electrically couple with a corresponding one of socket-side ring contacts 418. In certain embodiments, plug-side local contacts 412 are spring-loaded to engage corresponding socket-side ring contacts 418. One or more of socket-side ring contacts 418 includes a groove into which a corresponding one of local contacts 412 falls when connector plug 402 is fully installed. Engagement of the ring contact in the groove may inhibit connector plug 402 from pulling out of socket 416.

Figure 8:
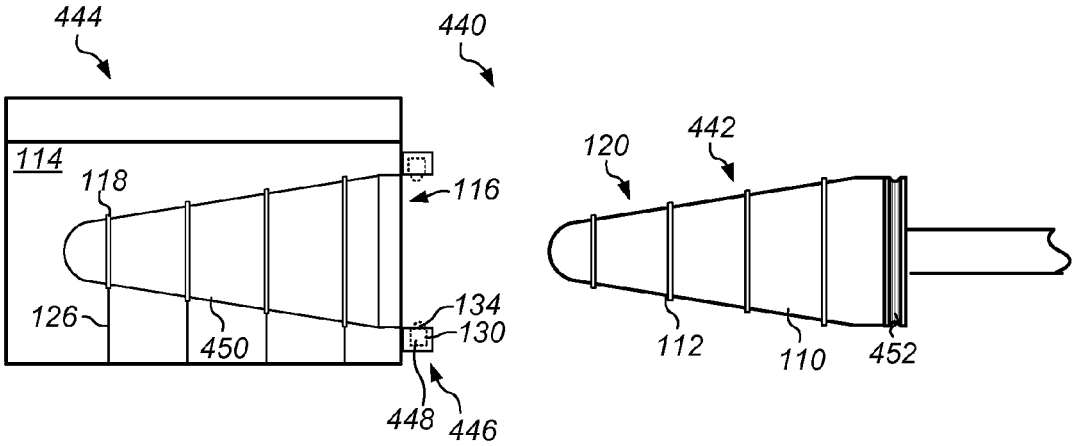
FIG. 8 illustrates one embodiment of a connector system with latch blocks external to socket.

In some embodiments, a latch mechanism for a connection system is located external to a socket for the connector receptacle. FIG. 8 illustrates one embodiment of a connector system with latch blocks external to socket. Connection system 440 includes connector plug 442 and connector receptacle 444. Latch mechanism 446 includes latch blocks 448. Latch blocks 448 are external to socket 450 of connector receptacle 444. Latch mechanism 446 may engage groove 452 of connector plug 442 to retain connector plug 442 in place in connector receptacle 444.

Figure 9:
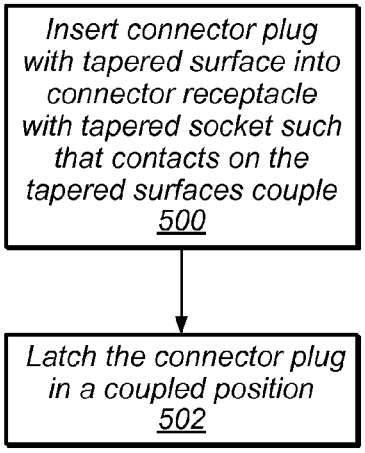
FIG. 9 illustrates one embodiment of making an electrical connection with a plug and receptacle with complementary tapered surfaces.

FIG. 9 illustrates one embodiment of a method of making an electrical connection with a plug and receptacle with complementary tapered surfaces. At 500, a connector plug having a tapered surface is inserted into a connector receptacle having a tapered socket such that one or more electrical contacts on the tapered surface of the plug couple with one or more electrical contacts on the connector receptacle. The tapered surfaces may include a conic surface, an arcuate surface, or flat faces.

At 502, the connector plug is latched in an installed position in the connector receptacle. An electrical connection is made between pairs of mating contacts. In some embodiments, the electrical connection is made regardless of the initial orientation of the connector plug in the connector receptacle when the connector plug is advanced into the socket.

The various methods as illustrated in the Figures and described herein represent exemplary embodiments of methods. The order of methods may be changed, and various elements may be added, reordered, combined, omitted, modified, etc.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. A system, comprising:

a connector plug comprising:

one or more tapered surfaces;

one or more plug-side body electrical contacts on at least one of the tapered surfaces;

a plug end surface, wherein the plug end surface is on one end of the plug and wherein an opposite end of the plug is configured to couple with one or more wires;

a plurality of plug-side tip electrical contacts on the plug end surface; and one or more electrically insulating portions on the at least one tapered surface; and a connector receptacle configured to receive the connector plug, and wherein the connector receptacle comprises:

a tapered socket, wherein the tapered socket comprises one or more tapered surfaces;

a socket end surface, wherein the socket end surface is configured to mate with the plug end surface; and one or more socket-side body electrical contacts, wherein at least one of the socket-side body electrical contacts is configured to electrically couple with at least one of the plug-side body electrical contacts when the connector plug is coupled to the socket, a plurality of socket-side tip electrical contacts on the socket end surface, wherein respective ones of the plurality of socket-side tip electrical contacts are configured to electrically couple with respective ones of the plug-side tip electrical contacts when the connector plug is coupled to the socket, wherein at least one of the socket-side body electrical contacts or the plug-side body electrical contacts extends at least partially around at least one of the tapered surfaces such that the at least one body electrical contact electrically couples with a mating electrical contact regardless of the orientation of the connector plug in the connector socket;

wherein a respective socket-side tip electrical contact or respective plug-side tip electrical contact, of each of a plurality of respective mating pairs of socket-side tip electrical contacts and plug-side tip electrical contacts, extends in a circular pattern on the socket end surface or the plug end surface such that the respective socket-side tip electrical contact or the respective plug-side tip electrical contact electrically couples with a mating end surface electrical contact regardless of the orientation of the connector plug in the connector socket;

wherein the one or more tapered surfaces of the connector plug or the one or more tapered surfaces of the connector receptacle is configured such that the connector plug is guided into the connector receptacle when inserted in the connector receptacle from a position that is at least partially out of alignment with the connector receptacle.

2. The connector system of claim 1, wherein at least one of the tapered surfaces of the connector plug comprises a conic portion.

3. The connector system of claim 1, wherein the connector plug comprises two or more electrical contacts on at least one of the tapered surfaces, wherein the connector receptacle comprises two or more electrical contacts on the tapered surface configured to couple with corresponding electrical contacts on the tapered surface of the connector plug.

4. The connector system of claim 1, wherein the tapered surfaces of the connector plug comprise two or more tapering facets.

5. The connector system of claim 1, wherein at least one of the tapered surfaces of the connector plug comprises one or more arcuate surfaces.

6. The connector system of claim 1, wherein at least one of the plug-side electrical contacts comprises a plug-side contact ring on at least one tapered surface on the connector plug, wherein at least one of the socket-side electrical contacts comprises a socket-side contact ring on at least one tapered surface on the connector receptacle, wherein the plug-side contact ring is configured to electrically couple with the socket-side contact ring.

7. The connector system of claim 1, wherein at least one of the electrical contacts on one side of the connection comprises at least one local contact configured to electrically couple with a ring contact on the other side of the connection.

8. The connector system of claim 7, wherein at least one of the local contacts is on the socket side of the connection.

9. The connector system of claim 7, wherein at least one of the local contacts is on the plug side of the connection.

10. The connector system of claim 1, wherein at least one of the socket-side electrical contacts is configured to resiliently engage at least one of the plug-side electrical contacts.

11. The connector system of claim 1, wherein at least one of the plug-side electrical contacts is configured to resiliently engage at least one of the socket-side electrical contacts.

12. The connector system of claim 1, further comprising a latching mechanism configured to inhibit separation of the connector plug from the connector receptacle when the connector plug is installed in the connector receptacle.

13. The connector system of claim 12, wherein the latching mechanism is external to the socket.

14. The connector system of claim 1, wherein at least one set of mating contacts are configured to couple with one another to inhibit separation of the connector plug from the connector receptacle.

15. The connector system of claim 1, wherein at least one of the plug-side electrical contacts comprises a ring.

16. The connector system of claim 1, wherein at least one of the electrical contacts on the connector plug is configured to transmit electrical power, wherein at least one other of the electrical contacts on the connector plug is configured to transmit data or a signal.

17. A connector plug, comprising:

one or more tapered surfaces, wherein at least a portion of the tapered plug is configured to be received in a socket of a connector receptacle;

one or more plug-side body electrical contacts on at least one of the tapered surfaces;

a plug end surface, wherein the plug end surface is on one end of the plug and wherein an opposite end of the plug is configured to couple with one or more wires;

a plurality of plug-side tip electrical contacts on the plug end surface; and one or more electrically insulating portions on the least one tapered surface, wherein at least one of the plug-side body electrical contacts extends at least partially around at least one of the tapered surfaces such that the at least one plug-side body electrical contact is configured to electrically couple with corresponding mating electrical contacts on the connector socket regardless of the orientation of the connector plug in the connector socket;

wherein the plurality of plug-side tip electrical contacts extend in a circular pattern on the plug end surface such that the plurality of plug-side electrical contacts are configured to electrically couple with corresponding mating electrical contacts on an end surface of the connector socket regardless of the orientation of the connector plug in the connector socket; and wherein the one or more tapered surfaces of the connector plug are configured such that the connector plug guides itself into the connector receptacle when inserted in the connector receptacle from a position that is at least partially out of alignment with the connector receptacle.

18. The connector plug of claim 17, wherein at least one of the tapered surfaces of the connector plug comprises a conic portion.

19. A connector receptacle comprising:

a tapered socket, wherein the tapered socket comprises one or more tapered surfaces and a socket end surface, wherein the tapered socket is configured to receive at least a portion of a connector plug;

one or more socket-side body electrical contacts on the one or more tapered surfaces; and a plurality of socket-side tip electrical contacts on the socket end surface, wherein at least one of the socket-side body electrical contacts extends at least partially around at least one of the tapered surfaces such that the at least one body electrical contact is configured to electrically couple with a mating electrical contact of the connector plug regardless of the orientation of the connector plug in the connector socket;

wherein the plurality of socket-side tip electrical contact extend in a circular pattern on the socket end surface such that the plurality of socket-side tip electrical contacts are configured to couple with respective mating electrical contacts on an end surface of the connector plug regardless of the orientation of the connector plug in the connector sockets;

wherein the one or more tapered surfaces of the connector receptacle are configured such that the connector plug is guided into the connector receptacle when inserted in the connector receptacle from a position that is at least partially out of alignment with the connector receptacle.

20. The connector receptacle of claim 19, wherein at least one of the tapered surfaces of the connector receptacle comprises a conic portion.

21. A method of a making an electrical connection, comprising:

inserting a connector plug having a tapered surface into a connector receptacle having a tapered socket from a position where the connector plug and the connector receptacle are at least partially misaligned;

guiding, by an interaction between the tapered surface of the connector plug and the tapered socket of the connector receptacle, the connector plug into alignment with the connector receptacle; and engaging a plurality of electrical contacts of the connector receptacle with corresponding electrical contacts of the connector plug, wherein engaging the electrical contacts of the connector receptacle with the corresponding electrical contacts of the connector plug comprises:

engaging one or more body electrical contacts of the connector receptacle or the connector plug with a corresponding electrical contact in the connector receptacle or the connector plug, wherein the one or more body electrical contacts extend at least partially around the tapered surfaced of the connector plug or the tapered socket of the connector socket such that the one or more body electrical contacts electrically couple with a mating electrical contact regardless of the orientation of the connector plug in the connector socket; and engaging a plurality of tip electrical contacts of the connector receptacle or the connector plug with corresponding electrical contacts on an end surface of the connector receptacle or on an end surface of the connector plug, wherein the plurality of tip electrical contacts extend in a circular pattern on a plug end surface or a socket end surface such that the plurality of tip electrical contacts electrically couple with a mating end electrical contact regardless of the orientation of the connector plug in the connector socket.

22. The method of claim 21, wherein the tapered surfaces of the connector plug comprise a conic portion configured to couple with a complementary conic portion on the connector receptacle, wherein inserting the connector plug into the connector receptacle comprises advancing the conic portion of the connector plug against the conic portion of the connector receptacle.

23. The method of claim 21, wherein the connector plug comprises two or more electrical contacts on the tapered surface, wherein inserting the connector plug into a the connector receptacle electrically couples at least two of the electrical contacts on the tapered surface of the connector plug with corresponding electrical contacts on the connector receptacle.

* * * * *